United States Patent [19]

Newman et al.

[11] Patent Number: 4,962,858

[45] Date of Patent: Oct. 16, 1990

[54] CLEANING SLUICE BOXES

[75] Inventors: John C. Newman, 811 Evergreen, Longview, Tex. 75604; Lloyd A. Molby, Longview, Tex.

[73] Assignee: John C. Newman, Longview, Tex.

[21] Appl. No.: 380,210

[22] Filed: Jul. 14, 1989

Related U.S. Application Data

[63] Continuation-in-part of Ser. No. 251,748, Oct. 3, 1988, abandoned.

[51] Int. Cl.[5] ..... B03B 7/00

[52] U.S. Cl. ..... 209/44; 209/430; 209/485; 209/501

[58] Field of Search ..... 209/44, 428, 429, 430, 209/500, 501, 485, 487, 506, 433, 492, 458, 460, 454, 462, 470

[56] References Cited

U.S. PATENT DOCUMENTS

| | | | |
|---|---|---|---|
| 228,915 | 6/1880 | McColl | 209/428 X |
| 327,708 | 10/1885 | Moffitt | 209/485 X |
| 588,832 | 8/1897 | Moore | 209/433 |
| 1,127,667 | 2/1915 | Newsom | 209/430 |
| 1,409,385 | 3/1922 | McDougall | 209/453 |
| 2,061,179 | 11/1936 | Wettlaufer | 209/433 X |
| 2,438,775 | 3/1948 | Bouwer et al. | 209/433 |
| 3,214,363 | 10/1965 | Amori | 209/313 |
| 4,272,363 | 6/1981 | Cargile, Jr. | 209/501 X |
| 4,352,733 | 10/1982 | Hibbard | 209/430 |
| 4,360,424 | 11/1982 | Pearson et al. | 209/458 X |

FOREIGN PATENT DOCUMENTS

| | | | |
|---|---|---|---|
| 20843 | 1/1936 | Australia | 209/428 |
| 102741 | 12/1937 | Australia | 209/433 |
| 2825419 | 12/1979 | Fed. Rep. of Germany | 209/430 |

*Primary Examiner*—Donald T. Hajec

*Attorney, Agent, or Firm*—James C. Fails; Arthur F. Zobal; Geoffrey A. Mantooth

[57] ABSTRACT

What is disclosed is method and apparatus for alleviating the problem with cleaning of sluice boxes. The invention is characterized by continuous cleaning of an endless belt onto which the heavy metal concentrate is projected by a conventional sluice boxes, shaker screens and the like, and eliminating the down time of the apparatus for cleaning, as in the prior art. This down time is approximately fifty percent of the time.

2 Claims, 3 Drawing Sheets

CLEANING SLUICE BOXES

CROSS REFERENCE TO RELATED APPLICATIONS

This is a continuation-in-part of application Ser. No. 07/251,748, filed Oct. 3, 1988, co-pending when this application was filed and now abandoned in favor of this application; same inventors, same title.

FIELD OF THE INVENTION

This invention relates to recovery of heavy metal concentrates. More particularly, this invention relates to recovering gold concentrate in which the gold may appear in about one part in one thousand instead of the conventional ore material where it may appear in one part per ten thousand or per hundred thousand or more.

BACKGROUND OF THE INVENTION

Recovering of heavy metal concentrates has taken a wide variety of forms. Even recovery of gold concentrates has taken a wide variety of forms ranging from the individual miners panning, or washing ore material from the more dense gold concentrate, and allowing the concentrate to appear in visible form in sluice pans or the like. These gold colored nuggets then were recovered by the miners. On the other hand, a variety of types of gold recovery have employed sophisticated mining from hydraulic mining in which the high pressure liquid was used to mine the ore material and to separate the lighter sand, dirt and the like from the more dense concentrate. On the other hand, certain offshore gold was recovered by large wheeled vehicles which suctioned the sedimentary material from the bottom of the shallow coastal region onto sluice boxes or the like where the lighter material was washed from the heavy metal concentrate and the heavy metal concentrate thereafter processed to recover the heavy metal, such as gold.

Only recently has the inventor of this invention added to these conventional techniques the use of a vibrating screen which has been found to be particularly satisfactory in facilitating recovery of the heavy metal concentrate.

In the prior art methods for recovering the heavy metal concentrate, such as the gold concentrate, has been the requirement that the gold concentrate collector, such as the bottom of the sluice box, has to be cleaned to remove therefrom the interfering material; such as sand, silt and the like; and recover the gold concentrate. This cleaning of the collector for the gold concentrate and returning to service of the sluice box has taken up to fifty percent of the time that the apparatus was used for recovering the heavy metal concentrate. It is desirable that some form of alleviating this problem be provided but the prior art has failed to do so.

Surprisingly, it has been found necessary to recirculate the water to keep from losing fine gold particles when the process of this invention is employed.

SUMMARY OF THE INVENTION

Accordingly, it is an object of this invention to provide apparatus and method for recovering a heavy metal concentrate in which the down time problem caused by having to clean sluice boxes and the like is eliminated.

It is a particular object of this invention to provide a method for alleviating the problem of the fifty percent down time of apparatus and provide a method for continuously recovering gold concentrate when processing ore materials containing the gold concentrate.

These and other objects will become apparent from the descriptive matter hereinafter, particularly when taken in conjunction with the appended drawings.

In accordance with one embodiment of this invention, there is provided an improvement in a method of recovering heavy metal concentrate which includes the step of dumping ore material containing more dense heavy metal concentrate and less dense material onto a material input hopper; washing the ore material to wash downwardly the washed material, forcing over riffles in a sluice box less dense material like sand, dirt and the like and allowing the more dense heavy metal concentrate to fall to the bottom of the sluice box, characterized by an improvement comprising collecting the more dense material, or heavy metal concentrate on an endless rotating belt having projecting fibers for catching the more dense heavy metal concentrate; moving the endless rotating belt and the more dense heavy metal concentrate in a direction opposite the downwardly washed ore material as the belt moves along its top traverse adjacent the downwardly washed ore material so as to trap the more dense heavy metal concentrate thereon and washing the belt with a high pressure water from a high pressure water spray nozzle to wash the heavy metal concentrate from the fibers of the belt and into a heavy metal concentrate collection chute means; and recycle the water to wash the belt with high pressure water to wash the heavy metal concentrate from the fibers of the belt and into the heavy metal concentrate collection chute means as delineated hereinbefore.

In accordance with another embodiment of this invention, there is provided an improvement in apparatus facilitating the recovery of a heavy metal concentrate from ore material, the apparatus including an input hopper for receiving ore material containing more dense heavy metal concentrate and less dense material such as dirt, sand and the like. A sluice box is provided and includes a vibrating screen and a rock tailing chute, the screen serving to vibrate the washed ore material to separate heavy metal concentrate and gold from the oversized less dense material. The remaining less dense material passing through the screen passes downwardly and over riffles in the rock tailing chute. The more dense heavy metal concentrate, which also passes through the screen, is allowed to fall to the bottom of the sluice box. A washing means is provided for washing the ore material including water sprayers for spraying water on the ore material and effecting downward movement of both the less dense material of the ore material and the more dense heavy metal concentrate of the ore material. The improvement is characterized by an endless belt moving about rollers, the endless belt having upwardly extending fibers for trapping thereon the heavy metal concentrate passed from the bottom of the sluice box; means such as a perforate, or foraminous, bottom for allowing the heavy metal concentrate to move from the bottom of the sluice box to the top surface of the belt while forcing the less dense material to pass over riffles in the sluice box; means for moving the belt such that its top moves in a direction opposite the downward flow of the washed ore material adjacent thereto; high pressure spray means for spraying at a proper position high pressure water on the endless belt to wash therefrom the heavy metal concentrate; and a heavy metal concentrate collecting chute disposed about and beneath the belt and the high pressure nozzles for collecting heavy metal concentrate for further processing; water recycle means for recycling water to the high pressure spray means to prevent loss of valuable gold concentrate; whereby the belt is cleaned continuously by the high pressure water spray and problems with the apparatus being out of service for cleaning are alleviated.

DESCRIPTION OF PREFERRED EMBODIMENTS

This invention may have application to a wide variety of heavy metal concentrate recovery systems; as in any placer mining or mining in which there is mining, suctioning, or dredging for ore material. It was developed however, with respect to recovering gold concentrate and it is with respect to this embodiment it will be described hereinafter.

As is recognized, gold is a noble, heavy metal and so tends to remain in relatively pure form in nuggets. Since gold is approximately at least six to seven times as heavy as sand and gravel of the same particle size, it tends to gravitate to the bottom of any "washed" type recovery system. For example, dirt, sand, and gravel tend to float over the top of riffles in a sluice box positioned at a certain angle of approximately one and one-half inches inclination per foot up to as much as two and one-half inches per foot. The material flows downgrade and the gold is slowed down and retained in the bottom of the sluice box under the riffles, which agitate the material to cause the high density gold to settle instead of flowing over the top of the riffles like the low density dirt, sand and gravel does.

In one of the most widely used systems, the gold falls to the bottom of a sluice box under riffles and is retained on a bottom material. When the sluice box becomes "dirty" it has to be cleaned, or gold is lost. If the bottom of the sluice box is not cleaned timely, gold particles tend to wash out with the tailings and be lost. Consequently, it is important that the gold be recovered in a timely fashion to prevent this loss. This "cleaning" incurs removing the riffles, removing the bottom material from the sluice box and taking it to a separate wash tank where the water streams wash to the gold out of the bottom and into a recovery wash tank. Then the entire recovery system has to be reassembled and the sluice box and the riffles system reinstalled. The gold system can then be re-started to recover gold again. This type of gold recovery processing system requires approximately half the time for shut-down to recover the gold from the bottom of the sluice box. This shutdown, cleaning, and recovery of gold is a time consuming and expensive process. Consequently, it is desirable that a gold recovery system be employed that would eliminate, or at least alleviate this problem of cleaning and recovering of the gold.

Figure 1:
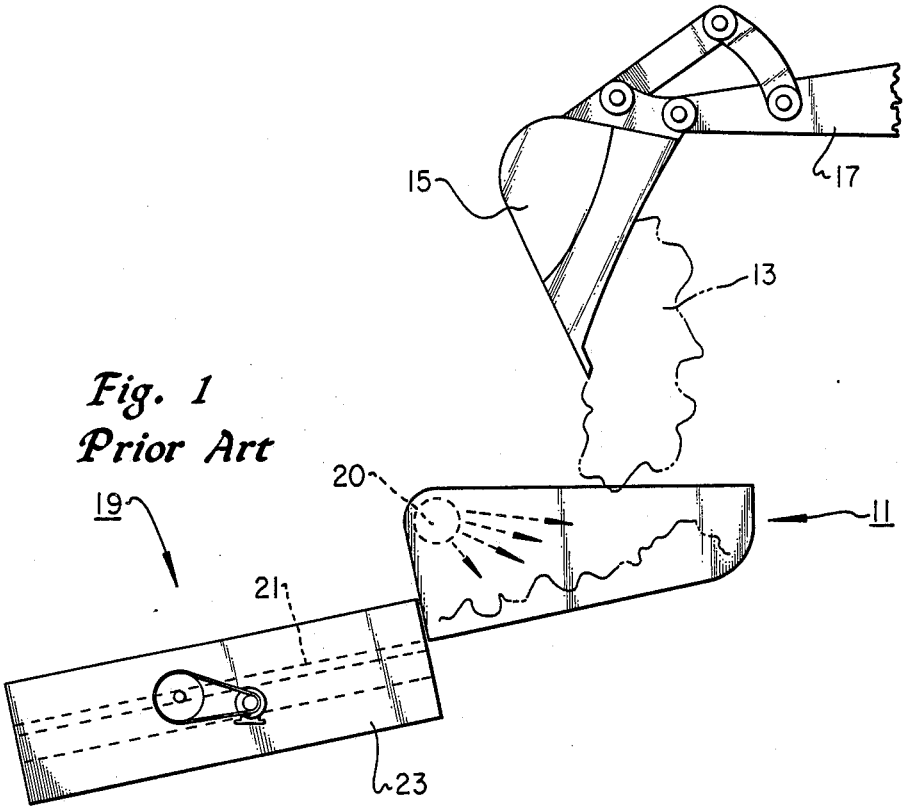
Fig. 1 Prior Art
FIG. 1 is a side elevational view, partly schematic, showing a reclamation system in accordance with the prior art.

Referring to FIG. 1, there is illustrated a prior art approach, even though it is relatively modern prior art, since it incorporates the vibrating screen. Specifically, there is illustrated an input hopper 11 for receiving ore material 13 dumped from a bucket 15 or the like which may be pivotally mounted onto heavy equipment 17. A sluice box 19 includes a vibrating screen 21 in the sluice box, as well as a grizzly chute 23. If desired, the grizzly chute 23 can be dispensed with and have the ore material go directly to the bottom of the sluice box 19 in this invention.

A wash means 20 in the form of a water sprayer is provided for spraying the ore material 13 in the input hopper 11 for washing the ore material to effect downward movement of the ore material so that the less dense material tends to float to the top and the more dense heavy metal concentrate, or gold concentrate, will move toward the bottom of the sluice box 19.

The present invention constitutes an improvement of the sluice box 19 taught by the prior art, as discussed above, and elements common to both will be referenced by common numerals. In the present invention, in the bottom of the sluice 19 are disposed the riffles 27, FIG. 2, over which the lighter material such as the dirt, sand and gravel tend to float during the downward movement of the washed ore material 13 from the input hopper 11. A lower tailing chute 29 carries off the rock tailings that have passed over the riffles 27.

Figure 2:
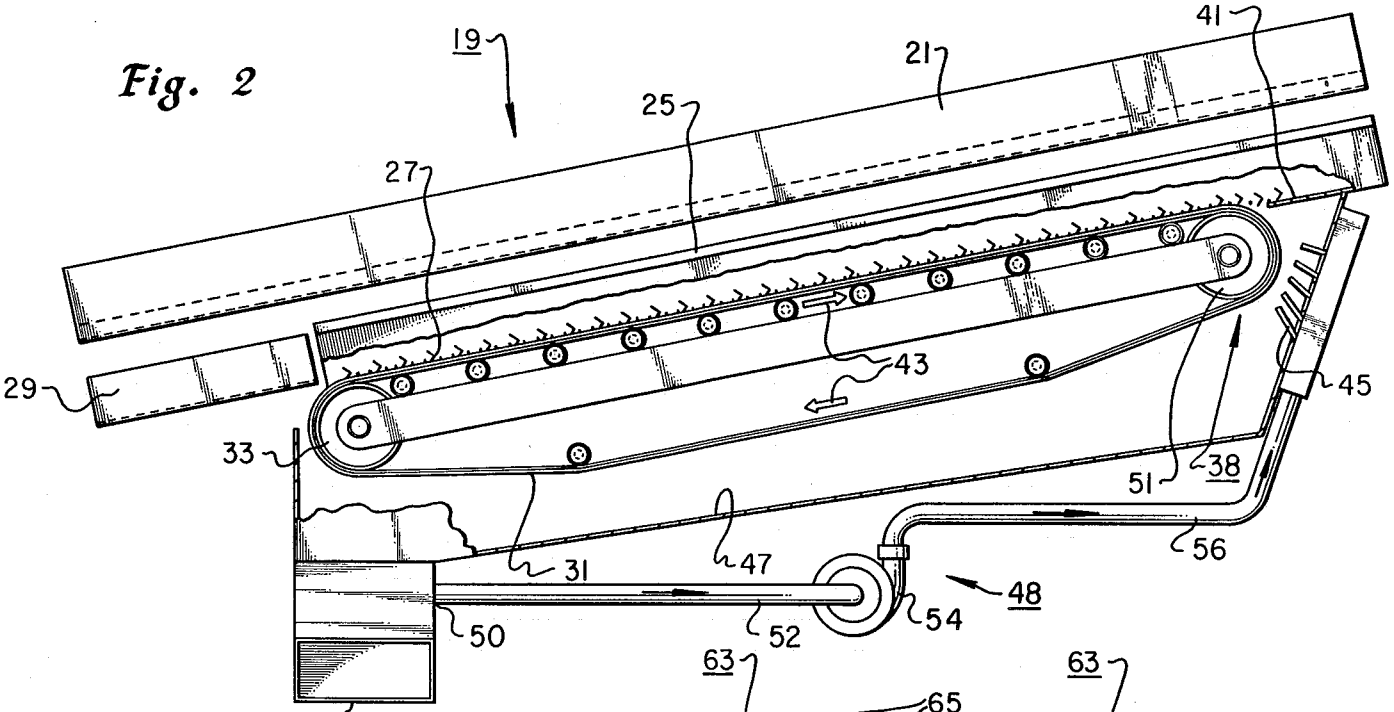
FIG. 2 is a side elevational view, somewhat schematic, showing one embodiment of this invention.
Figure 4:
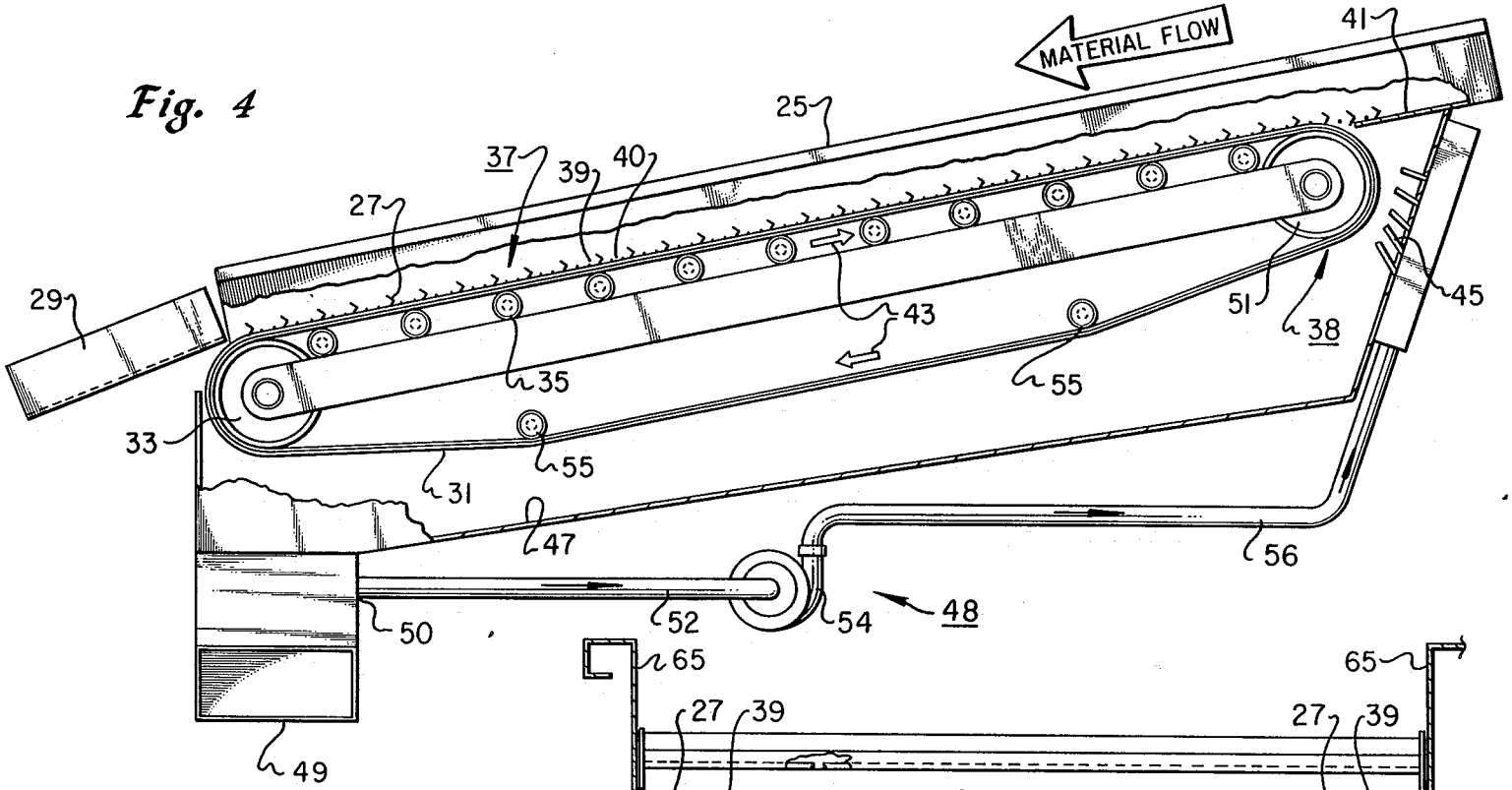
FIG. 4 is a side elevational view, providing somewhat greater detail of the embodiment of FIG. 2.

Referring to FIGS. 2 and 4, in accordance with this invention, there is an endless belt 31 that is moved about rollers. The rollers may be in the form of end rollers 33 and support rollers 35. There is provided a means for allowing the heavy metal concentrate to move from the bottom of the sluice box to the top surface of the belt 31. The means designated 37, FIG. 4, may comprise any suitable openings in the sluice box 19. As illustrated, the means 37 comprises openings, or slots between bars in the bottom of the sluice box 19. The term heavy metal concentrate in this instance is the gold concentrate from the gold ore 13. The invention also comprises a means 38 for moving the belt such that its top surface moves in a direction opposite the downward flow of the washed ore material adjacent thereto and within the sluice box. The bottom 41 of the sluice box is shown discontinuous in FIGS. 2 and 4.

Figure 3:
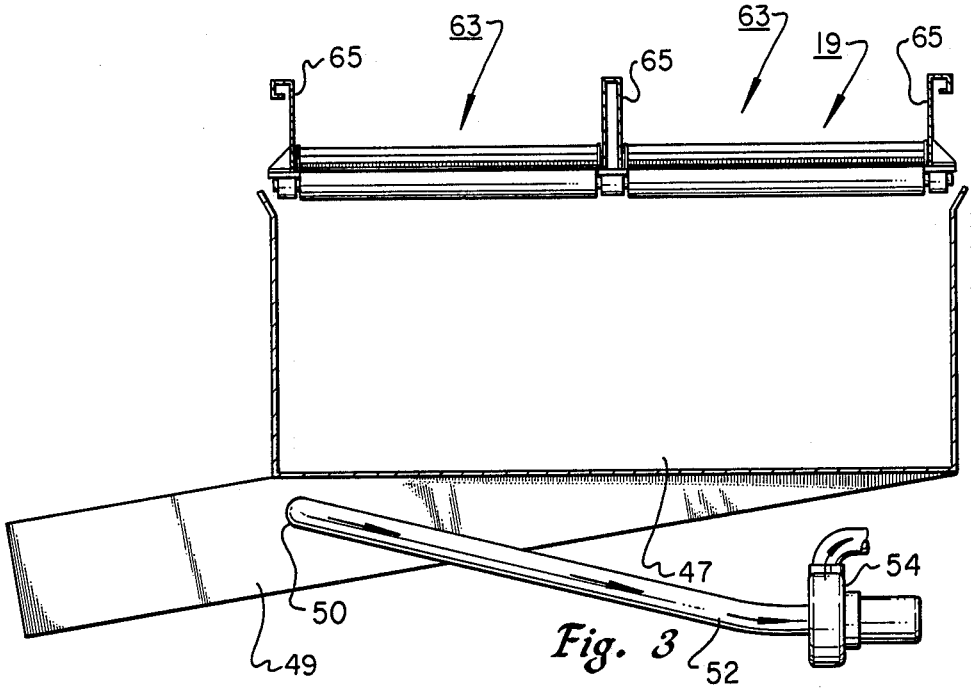
FIG. 3 illustrates a plurality of side-by-side reclamation units, or classifiers, in accordance with another embodiment of this invention. As with a single unit, a heavy metal concentrate chute is disposed beneath the respective reclamation units in the classifier.

It is relatively immaterial whether the bottom or top roller is powered, or even the idler and support rollers 35, as long as the belt is moved in an endless fashion so that the top passes beneath the bottom of the sluice box 19 for collecting of the gold concentrate thereon. As indicated by the arrows 43, the top of the belt passes countercurrent to the downward flow of the washed ore material (whereas, the bottom of the belt passes concurrently with it.) In this way, the gold concentrate that is washed therefrom by the water spray nozzles 45, can be collected in the gold concentrate trough 47 and chute 49. The gold concentrate is washed from the belt at the bottom of the top roller 51 of the means 39. As can be seen in FIGS. 3 and 4, a water recycle means 48 is employed. The water recycle means 48 includes an end cap 50, a suction conduit 52, a pump 54, and a high pressure discharge conduit 56 traversing from the pump 54 to the spray nozzles 45.

The gold concentrate, or heavy metal concentrate trough and chute 47 and 49 can be thought of as tailing chutes for the heavy metal concentrate tailings instead of the lighter less valuable tailings which go down the tailings chute 29. The gold concentrate is processed further to remove the "black sand" and other non-gold material.

It is imperative to note that the wash water in this system should be re-used; since the heavy metal concentrate, in particular fine gold, is lost if the water is not recirculated. This recirculation of the water also reduces the amount of water necessary for washing of the ore material.

Expressed otherwise, the self-cleaning sluice box of this invention can be described as a continuous Astroturf (a trademark for synthetic material simulating grass and having upstanding fibres therein) type belt moving against material flow, slowly or intermittently, rolling over a powered drumtype roller and support rollers with the belt being washed appropriately by high pressure water stream to cause the gold bearing concentrate to fall into a salvage hopper, or trough and chute, so the belt is cleaned without disturbing the material flow in the sluice box 19.

Although the endless belt has been described hereinbefore as being of Astroturf material, it is apparent any material that has upstanding fibers or the like secured to a flexible rubber conveyor belt can be employed to collect the gold concentrate.

As the belt rolls around the powered roller as part of the belt moving means 38, the gold is washed therefrom continuously. This prevents inadvertent exit of the gold material with the less valuable and lighter weight aggregate from the gold ore. Moreover, it alleviates the problem with downtime since it can be operated continuously and not have to reduce the ore removal, or washing equipment to about fifty percent of actual active working time.

The means 37 for allowing the heavy metal concentrate to move from the bottom of the sluice box to the top surface of the belt and for forcing the less dense material to pass over the riffles in the sluice box 19 are characterized by a plurality of rods 39 through a cut-out portion 40 of the bottom of the sluice box. Any other means that will give a foraminous type opening in which the gold concentrate can fall through onto the belt can be employed. The metal bars 39 have been found to be an excellent way of maintaining the sluice box 19 intact since they have adequate structural strength; yet, allow the dense gold particles of ore to fall therebetween and onto the belt 31 below. If desired, as indicated, a perforate structure such as a plurality of many holes can be employed as long as the holes were large enough to allow the particles containing the ore concentrate, or heavy metal concentrate, to fall onto the belt 31.

Figure 5:
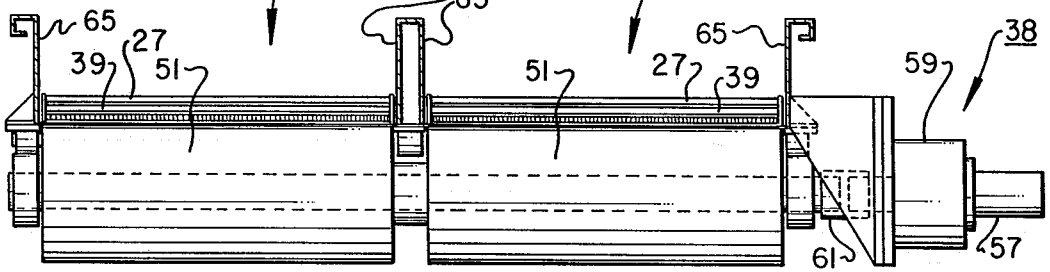
FIG. 5 is an end view of an embodiment of this invention such as illustrated in FIG. 4, illustrating how a single motor can be employed to run a plurality of reclamation units, or classifiers.

The means 38 for moving the belt may comprise any appropriate means. In the illustrated embodiment, it includes a powered end roller 51, FIGS. 2 and 4, with the bottom end roller 33 being an idler roller for the belt. Also included are idler rollers 55 which can be employed to control the belt tension. In addition, the support rollers 35, FIG. 4, serve as idler rollers as well as for supporting the belt 31 at its upper service immediately beneath the bottom of the sluice box. As can be seen in FIG. 5, the means for powering the belt, or moving the belt such that the top moves in a direction opposite the downward flow of the washed ore material, includes a motor 57, a reducing gear 59 and shaft connected by way of coupling 61 with the respective end rollers 51. As is recognized, a conventional motor employing whatever power is available, such as hydraulic power or electric power, can be employed for the motor 57. The gear reducer 59 may be any of the conventional gear reduction boxes. In the illustrated embodiment, the shaft going to the connector 61 is concentric with the motor 57. If desired eccentric arrangement could be employed, of course.

Figure 6:
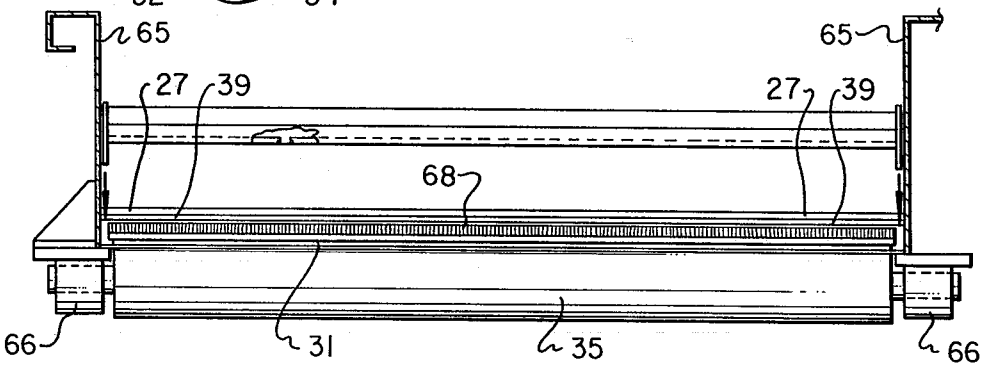
FIG. 6 is an end view, somewhat schematic, showing the roller bearings and the roller and riffle detail with respect to the endless belt.

Referring to FIG. 6, bearings 66 support the shaft for the respective rollers 35, so that the shaft is journalled and can be rotated as the belt is supported thereon. The belt 31 has upstanding fibers 68 for trapping gold concentrate. Typically it will be a belt of Astroturf-type material or the like. The spray nozzles 45 are scattered laterally across the belt so that the entire width of the belt is washed to free the gold concentrate to fall into the trough 47 and chute 49.

Over all, the system of this invention in which the endless belt can be continuously cleaned is referred to as a classifier 63. As can be seen in FIG. 3, a plurality of classifiers may be employed side by side with the gold concentrate trough 47 disposed therebeneath and a gold concentrate chute 49 employed to carry off the gold concentrate as part of the tailings with the water.

As illustrated in FIG. 6, each of the sluice boxes 19 may have sides 65 that constrain the tailings to follow downwardly along the predetermined course longitudinally of the sluice box 19. As illustrated in FIGS. 3 and 5, when a plurality of the sluice boxes 19, or classifiers 63, are placed side by side, the rollers may have a single shaft but the sides 65 may be joined to form a common side between two adjacent classifiers 63 as desired. It is preferred that when there is only one side, not joined, an additional crimp be made longitudinally of the sides for additional supporting strength to support the respective sides 65.

The water spray nozzles 45 are adapted to spray water from a high pressure source to wash the heavy metal concentrate from the belt 31.

In operation, the ore material 13 is picked up by a bucket 15 powered by suitable heavy equipment 17 and dumped into the inlet hopper 11. Recycled water from the sprayer 20 in the form of water spray from the high pressure nozzles 45 is employed to wash the ore material 13 and cause it to flow downwardly over the bottom of the sluice box 19 in a manner similar to that shown by the prior art. The first element that it will encounter in the sluice box is a vibrating screen 21. The vibrating screen 21 deflects any oversize material to be recycled. The ore material passed through the screen then flows into the rock tailing chute 25 and onto the bottom 41 of the sluice box 19. As it flows downwardly in the sluice box, the lighter aggregate such as dirt, sand and the like flow upwardly over riffles 27 whereas the heavy metal concentrate flows downwardly and through openings in the bottom of the sluice box and onto the belt 31. The belt 31 is moved, continuously or intermittently, around rollers so its top moves in the direction opposite to the downward motion of the ore material (referred to as rotating belt). As the belt passes over the top powered roller 51 of the means 39 for moving the belt, a high pressure jet of water from the nozzles 45 washes the gold concentrate from the belt as illustrated and into the gold concentrate trough where it flows downwardly through the gold concentrate chute 49 for further processing.

From the foregoing, it can be seen that this invention achieves the objects delineated hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. Apparatus facilitating recovery of a heavy metal from ore material, the apparatus including:

a. an input hopper for receiving ore material containing a more dense heavy metal concentrate and a less dense material including dirt and sand b. wash means for washing said ore material, including a water sprayer for spraying water on said ore material and effecting downward movement of said less dense material of said ore material and said more dense heavy metal concentrate of said ore material; the improvement comprising c. a sluice box including a vibrating screen and a rock tailings chute, said screen serving to vibrate the washed ore material to separate any oversized material, the remaining material passing through the screen to the bottom of said sluice box;

d. an endless belt moving about rollers; said endless belt having upwardly extending fibers for trapping thereon said heavy metal concentrate passed from the bottom of said sluice box;

e. means for allowing said heavy metal concentrate to move from the bottom of said sluice box for forcing said less dense material to pass thereover and allowing said more dense heavy metal concentrate to fall onto said belt;

f. high pressure spray means including high pressure nozzles for spraying high pressure water on said endless belt to wash therefrom said heavy metal concentrate;

g. a heavy metal concentrate collecting chute means disposed immediately beneath said belt and said high pressure nozzles for collecting heavy metal concentrate for further processing; and h. recycle means for recycling water and small particles of heavy metal concentrate to minimize loss thereof; whereby said belt is cleaned continuously by said high pressure water spray and problems with said apparatus being out of service for cleaning are alleviated.

2. The apparatus of claim 1 wherein said improvement comprising the elements d-h are employed in groupings called a classifier and a plurality of said classifiers are disposed in side-by-side relationships.

* * * * *